US006502339B1

(12) United States Patent
Shapiro

(10) Patent No.: US 6,502,339 B1
(45) Date of Patent: Jan. 7, 2003

(54) SHADOW DISPLAY DEVICE

(76) Inventor: Paul W. Shapiro, 6957 Columbus Ave., Van Nuys, CA (US) 91405-3559

( * ) Notice: Subject to any disclaimer, the term of this patent is extended or adjusted under 35 U.S.C. 154(b) by 17 days.

(21) Appl. No.: 09/596,337

(22) Filed: Jun. 19, 2000

(51) Int. Cl.[7] ..... G09F 13/00
(52) U.S. Cl. ..... 40/560; 40/577
(58) Field of Search ..... 40/560, 577, 42; 353/66, 52, 97, 102, 47

(56) References Cited

U.S. PATENT DOCUMENTS 1,761,360 A * 6/1930 Oberg et al. ..... 353/35
2,174,047 A * 9/1939 Stainbrook ..... 40/560

* cited by examiner

*Primary Examiner*—Cassandra Davis
(74) *Attorney, Agent, or Firm*—Steven M. Shape & Associates

(57) ABSTRACT

A shadow display device including at least two semi-transparent panels having images thereon which are positioned in front of or behind a light source casting images onto one or more of the panels. An embodiment of the device also includes a panel having an image which casts a shadow behind the light source which is enlarged on a wall or panel behind the device. The device may also include a switch to turn the light source on and off at the user's discretion.

12 Claims, 3 Drawing Sheets

SHADOW DISPLAY DEVICE

BACKGROUND OF THE INVENTION

This invention relates to shadow display devices and more particularly to a shadow display device which is aesthetically pleasing and projects images producing an overall visual appeal.

Devices previously available include various lamp designs and various shadow projecting devices for displaying images and text. U.S. Pat. No. 1,972,123 to Zimmerman discloses a shadow projector having a point source of light constructed without reflectors, condensers or lenses which is operative to project shadows of desired vertical and horizontal size. U.S. Pat. No. 3,561,861 to Mayer, et al. discloses a self-contained projector and a screen unit which can be actuated by a child to show a film strip in a sequential presentation. U.S. Pat. No. 3,762,083 to Lemons, et al. discloses a sky projector for projecting images on clouds or other atmospheric particles to create light, shadow and color effects.

The projection devices discussed above are relatively complex, costly and difficult to efficiently manufacture. Such devices are not aesthetically pleasing and do not produce images which complete scenes, ideas and similar thought transference. Thus, one object of the present invention is to provide a shadow display device which is simple in construction yet aesthetically appealing. In addition, it is an object of the present shadow display device to provide both a source of light and a decorative thought-provoking amenity to display in one's home, office or other suitable public location. It is yet a further object of the present invention to provide a shadow display device which includes multiple images which tell a story or complete a visual scene when viewed simultaneously providing entertaining thought transference.

Further objects and advantages of the present invention will appear from the following detailed description of the preferred embodiments and in the accompanying drawings.

DESCRIPTION OF THE INVENTION

Figure 1:
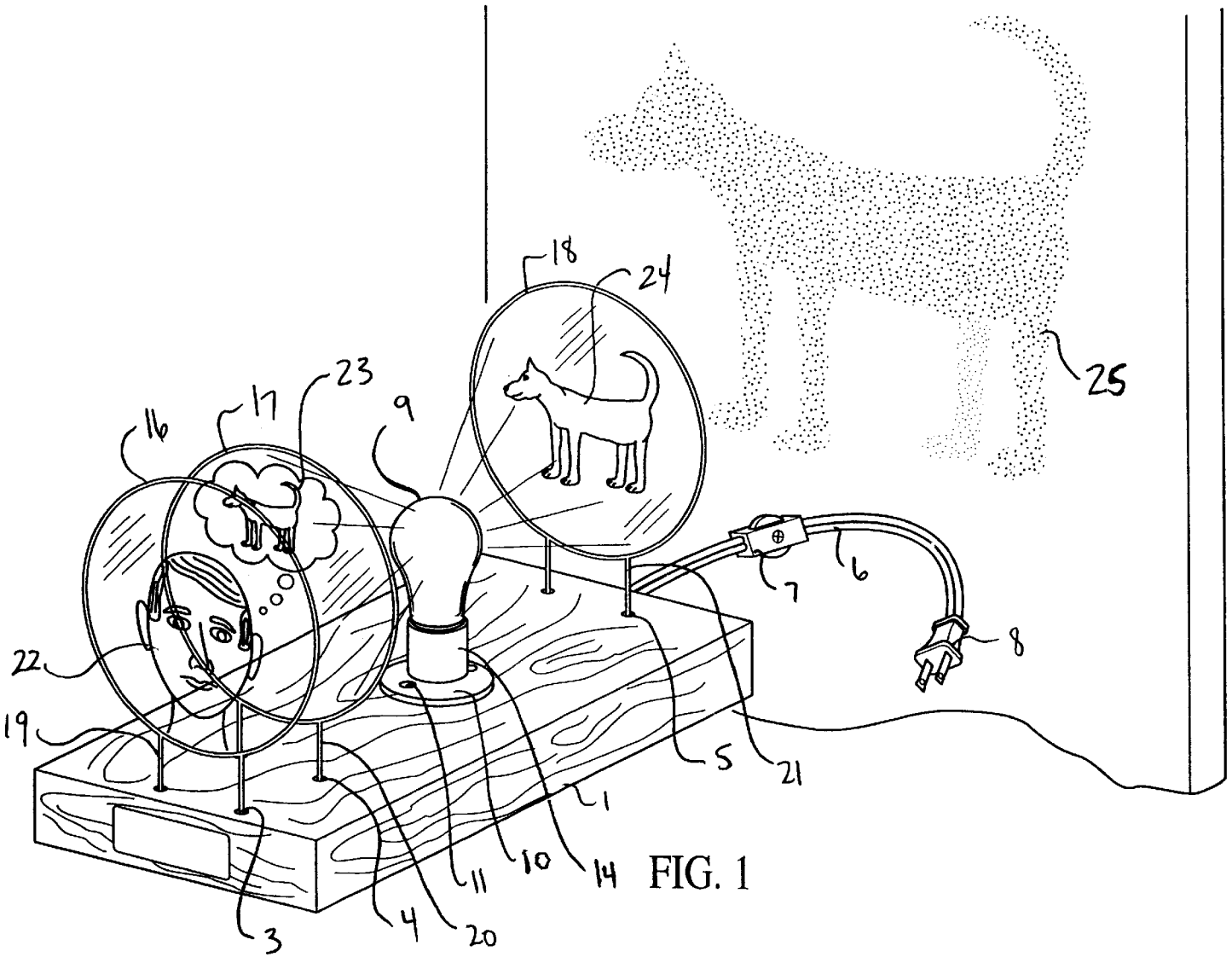
FIG. 1 is a perspective view of one form of the shadow display device of the present invention.

The shadow display device of the present invention includes a base 1 having an engraveable description plate 2 and apertures 3, 4 and 5 as illustrated in FIG. 1. A first semi-transparent panel 16 having a first image 22 thereon is mounted in front of light source 9. A second semi-transparent panel 17 is positioned behind panel 16 and includes a second image 23 thereon. Panel 17 is positioned behind panel 16 but also in front of light source 9. When light source 9 is illuminated, a shadow of image 23 on panel 17 is cast onto panel 16 such that the shadow of image 23 from panel 17 combines with the image 22 on panel 16 to form a complete image when viewed from the front of panel 16.

A third panel 18 having a third image 24 thereon is positioned behind light source 9. When light source 9 is illuminated, image 24 projects a shadow 25 onto the wall or other surface there behind. This third image, 24 when combined with images 22 and 23, further enhances the visual imagery produced by the device adding to the story and visual portrait to be conveyed to the viewer.

Figure 2:
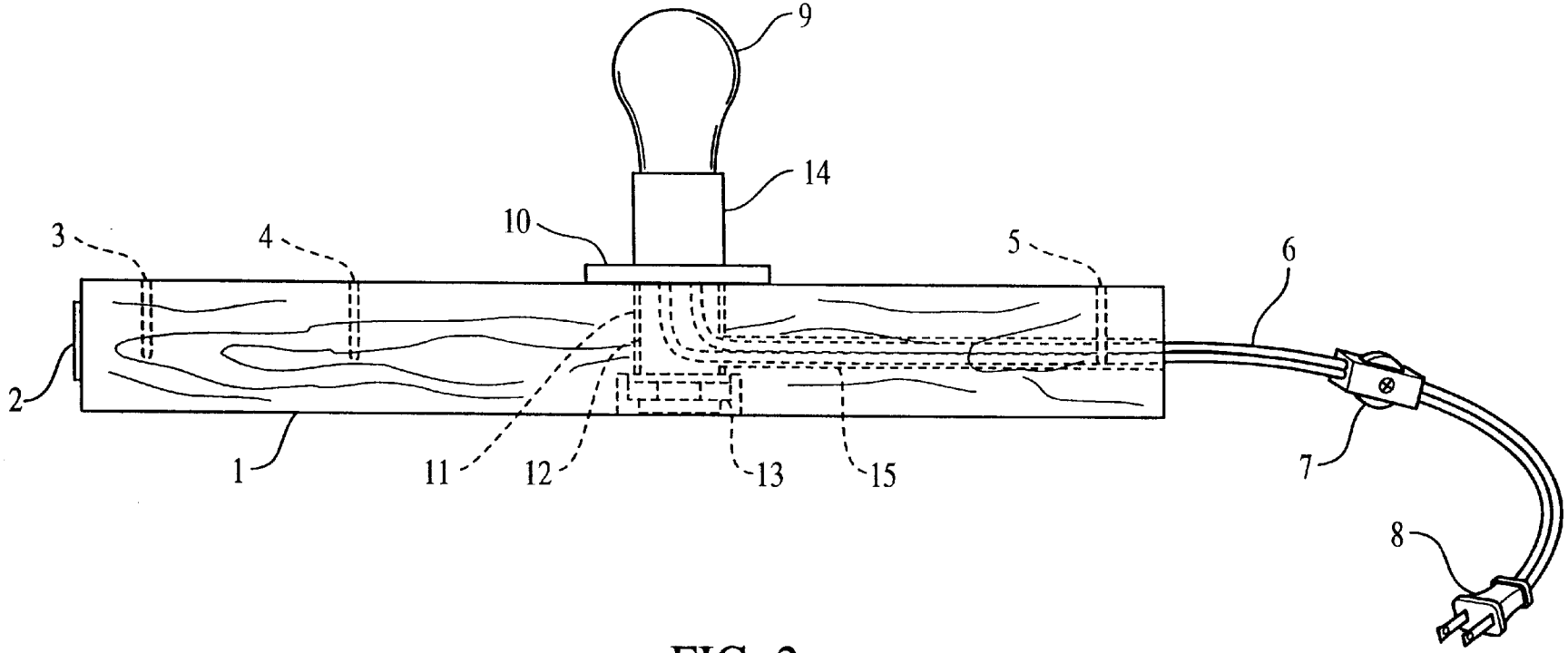
FIG. 2 is a front elevational view of the base of the invention showing the light source and mounting apertures.

As can be seen in FIGS. 1 and 2, base 1 includes apertures 3, 4 and 5 into which panels 16, 17 and 18 are mounted. Panels 16, 17 and 18 include legs 19, 20 and 21 which are positioned into apertures 3, 4 and 5 for mounting onto base 1. It may be appreciated that several sets of apertures may be included on base 1 to provide relative adjustment of panels 16, 17 and 18 with respect to one another and light source 9. In addition, light source 9, which includes a base 10 and receptacle 14, is positioned within aperture 12 on base 1. A mounting plate 13 is included on base 1 which accepts fasteners 11 which are positioned through base 10 to secure the light source 9 to base 1. In addition, aperture 15 is provided through which electrical cord 6 is positioned to supply electrical current to light source 9 when plug 8 is connected to an appropriate electrical source. In addition, switch 7 is included to provide actuation of light source 9. It may be appreciated that light source 9 may be any light source which provides sufficient light to cast the required shadows. Such light sources may include natural light or artificial light and include, but are not limited to, sunlight, ambient room light, battery operated light devices, electrically operated light devices and all such similar sources of light.

Figure 3:
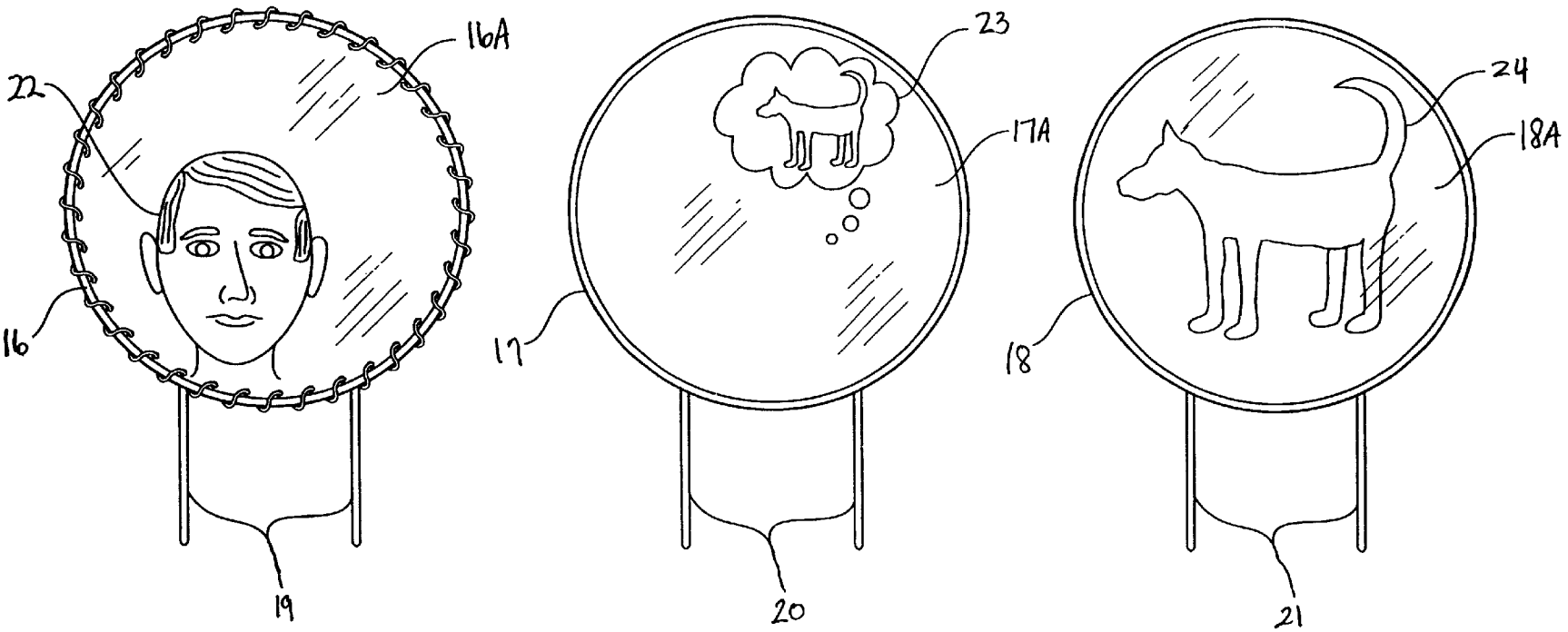
FIG. 3 is a front elevational view of each of the image panels showing the various images which when combined complete a thought, scene and/or theme.

As can be seen in FIGS. 1 and 3, panels 17 and 18 are constructed of a clear film material 17A, 18A, typically plastic film, onto which images, such as images 23 and 24, may be drawn, stenciled, adhered or otherwise placed thereon. Panel 16 includes a semi-transparent, opaque material 16A onto which an image such as image 22 may be drawn, stenciled, adhered, mounted or otherwise placed. Since panel 16 is the visual focus of the shadow display device, it may include other artistic enhancements, such as color, texture or the like. In addition, further aesthetics may include stitching the material of panel 16 to a frame as illustrated in FIGS. 1 and 3. Other alternatives may include sonic or heat welding, glue or other known methods to affix such plastic, fiberglass or other types of materials to a frame which may be constructed of wire, fiberglass, metal, plastic or the like.

In use, the shadow display device utilizes light from light source 9 which passes through panel 17 thereby casting a shadow of image 17 onto and in combination with the image 22 on panel 16. Furthermore, light from light source 9 simultaneously passes through panel 18 projecting a shadow 25 of image 24 onto a surface behind the device to complete a visual image. Such a complete image provides thought transference to the viewer which may be aesthetically pleasing, comical, informative or otherwise interesting. The device also functions as a source of light to illuminate a room while providing aesthetic and artistic appeal to the user. It is preferable that the material of panels 16, 17 and 18 be made of translucent material so that light rays will pass through the panels to cast shadows of the images thereon. Of course, various types of material may be used to create other aesthetic appeal to the device, including, but not limited to, the use of opaque, fiberglass, mylar, cloth or other semi-transparent, translucent or otherwise light diffusing material to create various moods, images or effects.

It may also be desirable to adjust the relative position of light source 9 with respect to panels 16, 17 and 18. It is also contemplated that the use of a suitable rheostat or dimming device may be employed for varying the intensity of light source 9.

The assembly of the present invention lends itself to multiple uses such as that of an entertainment device, advertising device, ornamental device and functional light source. In these capacities, the device may be modified for use as an ornament, conversational display, night light, table lamp, floor lamp, hanging lamp or other projection device in which a light source is used to display a shadow from an image, object, pattern or other model.

While there has been herein shown and described the presently preferring forms of the invention, it is to be understood that such has been done for purposes of illustration. It is contemplated that various modifications, changes and the like may be made to the present invention within the scope of the appended claims.

What is claimed is:

1. A shadow display device comprising:

a) a first semi-transparent panel having a first image thereon;

b) a second panel positioned with respect to said first panel with a second image thereon;

c) a light source positioned behind said first semi-transparent panel and said second panel which provides light by which a shadow is cast onto said first semi-transparent panel from said second panel to complete a visual scene;

d) a third panel having a third image thereon and positioned behind said light source such that a shadow of said third image is cast behind said third panel adding to said visual scene.

2. The shadow display device of claim 1 further comprising a base member onto which said first, second and third panels are mounted.

3. The shadow display device of claim 2, wherein said base member includes apertures in said base member for mounting said first semi-transparent panel, said second panel and said third panel thereon.

4. The shadow display device of claim 2, wherein said second panel comprises a clear film which is positioned on a first wire frame which is positionable on said base member and said third panel comprises a clear film which is positioned on a second wire frame which is positionable on said base member.

5. The illuminated shadow display device of claim 4, wherein said second and third panels are glued to said first and said second frame, respectively.

6. The shadow display device of claim 1, wherein said light source comprises an artificial light source and includes means for switching said light source on and off.

7. The shadow display device of claim 1, wherein said first semi-transparent panel is comprised of translucent material onto which said first image is placed.

8. The illuminated shadow display device of claim 7, wherein said first semi-transparent panel is comprised of fiberglass material onto which said first image is placed.

9. The illuminated shadow display device of claim 7, wherein said first semi-transparent panel comprises fiberglass material which is affixed to a frame through the use of a thread such that said fiberglass material is sewn onto said frame.

10. A shadow display device comprising:

a) a base member;

b) a light source mounted to said base member;

c) a first semi-transparent panel having a first image thereon affixed to a first frame mountable onto said base member and positioned on one side of said light source;

d) a second panel having a second image thereon affixed to a second frame mountable onto said base member and positioned behind said first semi-transparent panel and on said one side of said light source; and e) a third panel having a third image thereon affixed to a third frame mountable onto said base member and positioned behind said second panel and on the opposite side of said light source from said first semi-transparent panel and said second panel.

11. The shadow display device of claim 10, wherein light from said light source passes through said second panel such that a shadow of said second image is cast onto said first semi-transparent panel and wherein light from said light source passes through said third panel projecting a shadow of said third image onto a surface behind the device, such that a complete visual image is displayed to a viewer.

12. The shadow display device of claim 11, further comprising switch means for adjusting intensity of said light source.

* * * * *